United States Patent [19]

Murase

[11] Patent Number: 4,691,540

[45] Date of Patent: Sep. 8, 1987

[54] LOCK FOR SLIDE FASTENER

[75] Inventor: Mikio Murase, Osakafu, Japan

[73] Assignee: Osaka Trunk Material Co., Ltd., Osaka, Japan

[21] Appl. No.: 907,849

[22] Filed: Sep. 16, 1986

[30] Foreign Application Priority Data

Feb. 7, 1986 [JP] Japan ..... 61-17211[U]

[51] Int. Cl.[4] ..... E05B 67/38

[52] U.S. Cl. ..... 70/68; 70/75

[58] Field of Search ..... 70/68, 67, 69, 70, 71, 70/72, 73, 74, 75, 76; 24/386, 387, 425, 436

[56] References Cited

U.S. PATENT DOCUMENTS 2,677,952 5/1954 Stoe ..... 70/68

3,206,953 9/1965 Atkinson ..... 70/70

4,015,457 4/1977 Fukuroi ..... 70/68

4,514,884 5/1985 Keneko ..... 70/68

*Primary Examiner*—Robert L. Wolfe

*Attorney, Agent, or Firm*—Browdy and Neimark

[57] ABSTRACT

A lock for a slide fastener to be installed in a catch plate of a first slider, which comprises a case to be connected to the first slider, a sliding plate slidably contained in the case and a locking member rotatably contained in the case. The sliding plate is guided by an inner surface of the case and a guide pin which is inserted through a slot of the sliding plate. The locking member and the sliding plate are engaged for locking of the slide movement of the sliding plate.

Movable elements is reduced, and therefore the mechanism, construction and operation thereof are simple, smooth and easy.

8 Claims, 6 Drawing Figures

LOCK FOR SLIDE FASTENER

BACKGROUND OF THE INVENTION

The present invention relates to a lock for a slide fastener.

There have been used in prior art a pair of slide fasteners each of which can close a half of an aperture in order to easily close the whole aperture of a bag, suitcase, or the like. It has been also known that a lock comprising a means for connecting sliders of the pair of slide fasteners with each other, and a locking mechanism for keeping the sliders in a connected state is installed in one of the catch plates of the sliders.

As an example of the above-mentioned type of lock for a slide fastener, U.S. Pat. No. 4,514,884 discloses a lock having two movable elements in addition to a locking member to be operated to be rotated by a key. The movable elements move perpendicularly to each other, and a return spring is employed per each movement of the movable elements. Therefor, the conventionaly known lock is relatively complicated in mechanism and structure.

A main object of the present invention is to provide a lock which requires a small number of movable elements in comparison with the known lock and is simple in mechanism and structure, and therefor, which is easy to assembly and cheap in cost of production.

Other objects and advantages will become apparent through the following description.

SUMMARY OF THE INVENTION

According to the present invention, there is provided a lock for a slide fastener comprising a sliding plate having an engaging surface at one side thereof, a tongue at another portion thereof, and a guide slot or groove extending in the same direction as that of the tongue, a case body containing the sliding plate for reciprocal sliding movement of the sliding plate in the direction of the guide slot or groove, a guide pin statically provided in the case body for slidably guiding the guide slot or groove, a spring provided in the case body for elastically urging the sliding plate in the same direction and sense as that of the tongue, a locking member is rotated to case body for rotational movement so as to engage with the engaging surface of the sliding plate in the same direction and reciprocal sliding movement when the locking member is rotated to one position and so as to disengage with the engaging surface when rotated to the other position, a spring for alternatively holding the locking member in the above positions, and a cover plate for the case body, having a connecting portion to be connected with a first slider and having a hole adapted to receive a connecting projection of a second slider at a location corresponding to the engaging tongue.

Hereinafter, the present invention will be explained in detail with reference to a suitable embodiment with the accompanying drawings.

DETAILED DESCRIPTION OF THE INVENTION

Figure 1:
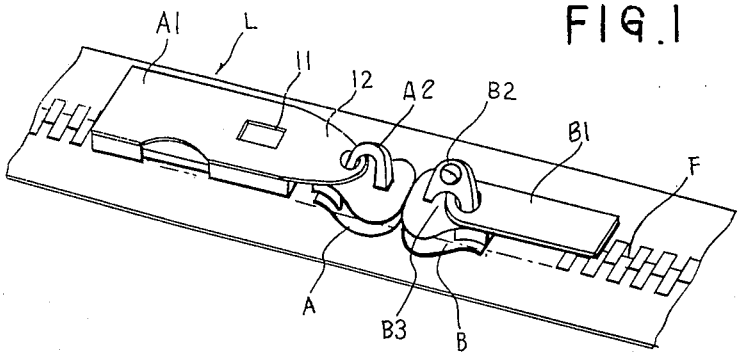
FIG. 1 is a perspective view showing an example of a pair of sliders one of which is provided with the lock according to the present invention, in a non-connected state.
Figure 2:
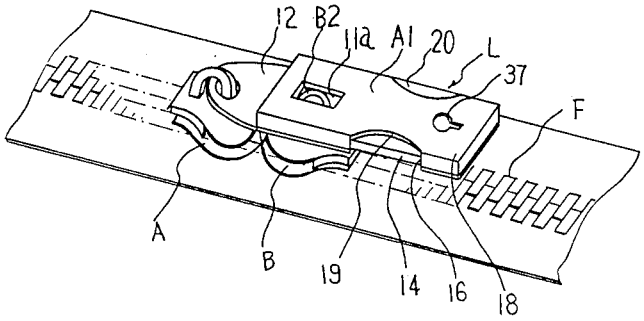
FIG. 2 is a perspective view of the sliders shown in FIG. 1 in a connected state.

As shown in FIGS. 1 and 2, the lock L of the present invention is a device for connecting one slider A (hereinafter referred to as "first slider") and the other slider B ("second slider") with each other and for locking the connected state. The lock L is installed in a catch plate A1 of the first slider A, and the catch plate A1 is connected with the second slider B by utilizing a projection B2 which is originally a means for connecting a catch plate B1 to the second slider B. The reference mark F in FIGS. 1 and 2 shows fasteners.

Figure 3:
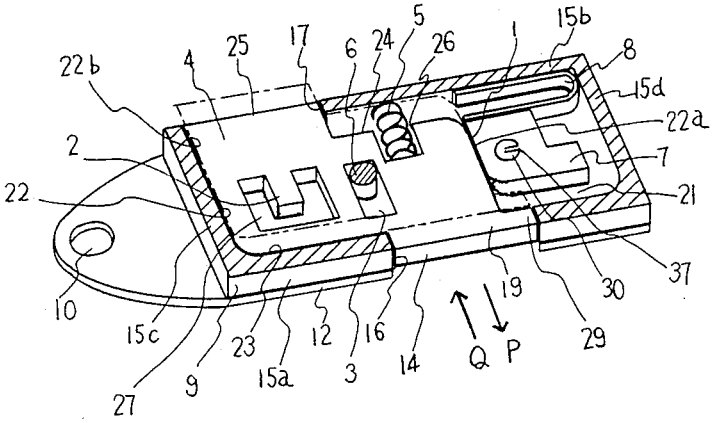
FIG. 3 is a partially cutaway perspective view of an embodiment of the lock according to the present invention.

Referring to FIG. 3, the lock L according to the present invention includes a sliding plate 4. The sliding plate 4 is provided with an engaging surface 1 at one side edge 22*a* thereof and a tongue 2 near the other side edge 22*b* thereof. The sliding plate 4 is further provided with a guide slot 3 between the engaging surface 1 and the tongue 2.

A spring 5 for elastically urging the sliding plate 4 in the direction of the tip of the tongue 2, i.e. in the direction of an arrow P, a guide pin 6 inserted through the guide slot 3, a locking member 7 for locking the sliding movement of the slide plate 4, and a leaf spring 8 are all together set in a lock-case comprising a case body 9 and a cover plate 12.

The cover plate 12 is provided with a connecting portion 10 to be connected with a connecting projection A2 of the first slider A at an end thereof and a hold 11 which is shown in FIG. 1 at a location corresponding to the tongue 2. The cover plate 12 is fixed on the case body 9.

Now, main partial structures and functions thereof will be described in detail with reference to FIG. 3.

The case body 9 has an oblong box-like shape having a bottom plate 18 and side walls 15*a* to 15*d* on the periphery thereof. In FIG. 3, the bottom plate 18 of the case body 9 is cut-away for clearly illustrating the inner state of the lock L.

At longer side walls 15*a* and 15*b*, windows 16 and 17 respectively are open. Both the bottom plate 18 of the case body 9 and the cover plate 12 are provided with arc-shaped cutout portions 19 at each side edge adjacent to the window 16 of the side wall 15*a*, respectively. The cutout portions 19 are provided for push-operation in the direction of the arrow P on the operative portion 14 of the sliding plate 4 as described later in detail. In addition, a decorative relief cutout portion 20 having the same shape as the cutout portion 19 is formed or stamped on the base plate 18 in symmetrical arrangement with the cutout portion 19 of the bottom plate 18.

The cover plate 12 is fixed on an opening of the case body 9 (at a lower side in FIG. 3), and therefore, a flat inner space 21 is obtained in the lock-case. Though the hole 11 in the cover plate is necessary for the cover plate 12, a hole 11*a* in the bottom plate 18 is not an essential feature in the present invention. However, the hole 11*a* may be formed in the bottom plate 18 of the case body 9 as shown in FIG. 2.

The guide pin 6 may be fixed to either one of the bottom plate 18 or the cover plate 12. Though the top end of the guide pin 6 is generally abutted against the opposite plate 12 or 18, the guide pin 6 may be short in length so as not to abut the opposite plate 12 or 18. In that case, a guide groove having a bottom may be used instead of the guide slot 3.

The above-mentioned sliding plate 4 is inserted in the flat inner space 21 of the lock-case, and a linear edge surface 22*b* of the sliding plate 4 is guided by the inner surface of the shorter side wall 15*c*. The guide groove or slot 3 is guided by the guide pin 6 so that the sliding plate 4 reciprocally moves in the direction of arrows P and Q.

The sliding plate 4 is provided with a first shoulder portion 23 and an operative portion 14 on the longer side edge adjacent to the longer side wall 15*a* of the case body 9. The first shoulder portion 23 is rested against the inner surface of the side wall 15*a*, and the operative portion 14 looks out of the window 16 for push-operation by an operator's finger.

On another side edge of the sliding plate 4, there is a second shoulder portion 24 for abutting against the other side wall 15*b* when the sliding plate 4 is operated toward arrow Q together with a projection 25 capable of going out of and coming into the other window 17 when the sliding plate 4 is reciprocally operated.

In the present embodiment, the shoulder portions 23 and 24 have a function to determine the limit of a slidably linear movement of the sliding plate 4 by means of abutting against the opposite inner surfaces of the side walls 15*a* and 15*b*. However, it is to be understood that the present invention is not limited to that embodiment. For example, the set of guide pin 6 and guide slot 3 or another stopper mechanism may be employed in the present invention.

The above-mentioned projection 25 is not an essential feature for the present invention. However, if the projection 25 and the window 17 are provided for the lock, a stable sliding operation of the sliding plate 4 can be advantageously obtained since the whole of the inner surface of the shorter side wall 15*c* can act as a guide surface for the sliding plate 4.

A coil spring 5 is inserted between the second shoulder portion 24 and the side wall 15*b* in order to elastically urge the sliding plate 4 in the direction of arrow P. In the embodiment illustrated in FIG. 3, a cutout portion 26 for containing and for stably holding the coil spring 5 is formed in the first shoulder portion 24.

When a groove having a bow-shaped section is formed in the inner surface of the bottom plate 18 and/or the cover plate 12 at a location adjacent to the coil spring 5, a coil spring 5 having a diameter larger than the thickness of the sliding plate 4 can be employed. In that case, a coil spring strong in urging force can be advantageously set in a compact state.

In addition, a leaf spring (not shown) similar to the leaf spring 8 may be employed instead of the coil spring 5. In that case, since the first shoulder portion 23 cannot be used for determining the limit of the movement in the direction of an arrow Q of the sliding plate 4, another stopper mechanism, for example, another projection projecting from the first shoulder portion 23 or the above-mentioned set of guide pin 6 and guide slot 3, should be employed to determine the limit of the movement.

A square hole 27 is perforated between the edge 22*b* and the guide slot 3, and a tongue 2 is projected in the same direction as the coil spring 5-urging-direction, i.e. in the direction of arrow P.

According to the above-mentioned construction, the sliding plate 4 is elastically urged in the direction P by the coil spring 5, and the first shoulder portion 23 usually abuts against the inner surface of the side wall 15*a* as shown by real lines in FIG. 3. In that state, the tongue 2 appears in the area of the hole 11. When the lock L is pinched by user's fingers to push the operative portion 14 into the flat space 21, the sliding plate 4 moves in the direction of arrow Q and the tongue 2 is withdrawn from the area of the hole 11. When the fingers are released, the sliding plate 4 moves in the direction of arrow P to return to the original position, and the tongue 2 also appears in the area of the hole 11. Therefore, if the connecting projection B2 of the second slider B is inserted when the tongue 2 is withdrawn, the tongue 2 is inserted through a hole B3 of the connecting projection B2 after the tongue 2 returns to the original position.

As is described above, the engagement operation between the first and second sliders can be performed. On the contrary, the disengagement operation can be performed in the reverse order. Hereinafter, the locking mechanism and operation thereof will be described in detail with reference to FIGS. 4 and 5.

The engaging surface 1 (shown in the right hand side of FIGS. 4 and 5) of the sliding plate 4 comprises a linear portion 28 extending in the sliding direction of the slide plate 4 and a stopper portion 29 adjacent to the above-mentioned operative portion 14.

A L-shaped locking member 7 adjacent to the engaging surface 1 is rotatably supported by the case body 9. A rotatable axis 30 of the locking member 7 can be operated to rotate only by a key having a specified profile. The locking member 7 has four operative side edges, i.e. first to fourth side edges.

Figure 4:
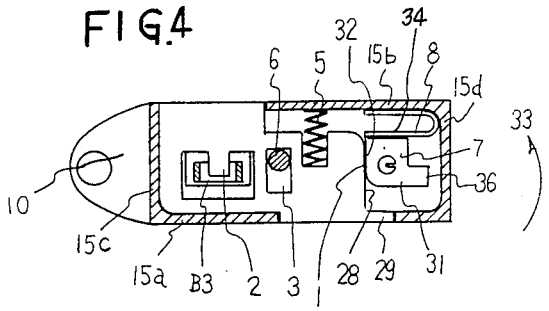
FIG. 4 is a partially cutaway plan view showing the lock in FIG. 3, in a non-locked state.

In the unlocked position shown in FIG. 4, there is a space between the stopper portion 29 and the first side edge 31 of the locking member 7, and therefore, the sliding plate 4 can be reciprocally operated in the directions of the arrows P and Q. In that state the second side edge 32 is slidably abutted with the linear portion 28 of the engaging surface 1 as a guide for the sliding plate 4. Further, the locking member 7 is not rotatable in the counter-clockwise direction, i.e. in the direction of arrow 33, due to the abutment between them.

A U-shaped leaf spring 8 is inserted between the third side edge 34 and the inner surface of the side wall 15*b*, and therefore, the locking member 7 can be stably kept in the unlocked position.

Figure 5:
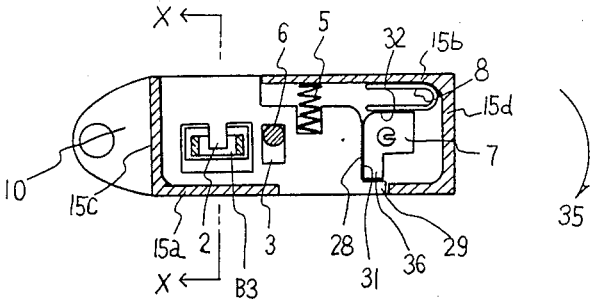
FIG. 5 is the same plan view as that of FIG. 4 but in a locked state.

Next, when the locking member 7 is operated to rotate in the direction of arrow 35, i.e. in the clockwise direction, against the urging force of the leaf spring 8, by means of the key (not shown) by almost 90 degrees, and then, comes to the locked position as shown in FIG. 5. In that state, the locking member 7 can be stably kept in the locked position by the leaf spring 8. Further, the first side edge 31 mentioned above abuts with the linear portion 28 of the sliding plate 4, and an abutting portion 36 having a long radius arm from the rotational center of the locking member 7 is engaged with the inner surface of the stopper portion 29 of the sliding plate 4. Therefor, the locking member 7 cannot be rotated further in the direction of arrow 35. In this locked state, sliding plate 4 cannot be operated to slide in the direction of either arrow P or arrow Q.

Hereinafter, an operation process of the above-mentioned lock will be described.

After the pair of fasteners F are closed by the corresponding sliders A and B, respectively (see FIG. 1), the catch plate A1 with the lock L is turned and overlapped on another catch plate B1. In that operation, the operative portion 14 is pushed to slide the sliding plate 4 toward arrow Q against the urging force of the spring 5 and to withdraw the tongue 2 from the area of the hold 11. In that state, the connecting projection B2 of the slider B is inserted into the hole 11. Next, the force applied on the operative portion 14 is released to return the sliding plate 4 to the original position by means of the urging force of the coil spring 5 and the tongue 2 is engaged with the hole B3 of the connecting projection B2 (see FIGS. 3 and 4).

Further, a key is inserted into the key hold 37, and the key and the locking member 7 is rotated in the clockwise direction by, for example, 90° (see FIG. 5). Then the key is drawn. In this state, even if the operative portion 14 is pushed by the user's finger, the sliding plate 4 is not moved, since the abutting portion 36 abuts against the stopper portion 29.

The lock releasing process goes in the reverse order of the above-mentioned locking process. That is to say, the key is again inserted into the hole 11, and the locking plate 7 is rotated in the counter-clockwise by 90°. Next, the operative portion 14 is pushed to disengage the engagement between the tongue 2 and the hole B3. After that, each slider A, B can be freely operated to open or close the corresponding fastener F.

It can be clearly understood that, in the lock of the present invention, the engagement function and the disengagement function of the sliding plate 4 can be advantageously performed by the same operation of only one movable element, i.e. the push-and-release operation to the operative portion 14. Therefore, the operation of the lock of the present invention is very simple in comparison with the conventional lock which has two movable elements. Further, of course, the frictional resistance due to the sliding operation is reduced over that of the conventional two-element type, since the number of the slidably movable element is only one.

Accordingly, the engagement and disengagement operation between the two sliders A and B to be engaged can be easily and smoothly performed. Further, there is another advantage that there are few mechanical troubles, since the number of the movable parts is small.

In addition, in the lock of the present invention, the engagement of the engaging tongue and the locking operation are not performed when the sliding plate 4 is shifted against the return spring from the original position, but are performed at just the state that the sliding plate 4 is returned to the original position. Therefore, loaded conditions for the parts of the lock, e.g. the return coil spring 5 or the locking member 7 are not continued for a long period of time.

Therefore, the above-mentioned two states (engaged state and locked state) are very stable, and there are few troubles with the lock even if the fastener F receives an impact from outside.

Hereinafter, a partial preferable variation will be explained with reference to FIG. 6.

Figure 6:
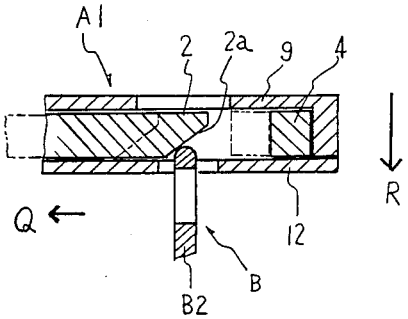
FIG. 6 is a partial sectional view, corresponding to the section obtained on line X—X of FIG. 5, showing another embodiment of the present invention.

In the variation of FIG. 6, the lower surface 2*a* of a tongue 2 is slanted so that the thickness of the tongue 2 is tapered toward the tip thereof. The slant angle may be, for example 45°.

In that variation, when the lower surface 2*a* of the tongue 2 is pressed against the upper end of the connecting projection B2 of the second slider B, the slider 4 is pushed in the direction of arrow Q. Accordingly, it is not necessary to operate to push the operative portion 14 when the engagement between sliders A and B is performed, and a pressing operation of the catch plate A1 in the direction of arrows R is only required so that the connecting projection B2 is inserted into the hole 11.

In this variation, also, the disengagement operation can be performed by the sliding operation of the sliding plate 4 through the operative portion 14 as is explained with reference to FIG. 3.

Though preferable embodiments of the present invention are described above with reference to accompanying a drawings, it is to be understood that the present invention is not limited to the above-mentioned embodiments, and various changes and modifications may be made in the invention without departing the spirit and scope thereof.

What we claim is:

1. A lock for a slide fastener for locking together a first and a second slider with the lock connecting the first slider to a projection on the second slider, the lock comprising a single integral sliding plate having
an engaging portion on one side thereof,
and a tongue spaced from said engaging portion;

a guiding portion extending in a direction parallel to said tongue;

a case body for containing said sliding plate for reciprocal sliding movement of said sliding plate in the direction longitudinally of said guiding portion;

a corresponding guide member provided in said case body for slidably guiding said guiding portion;

a spring provided in said case body for elastically urging said sliding plate in the direction of extension of said tongue;

a locking member rotatably mounted to move between lock and unlock positions in said case body adjacent to said engaging portion;

said locking member mounted to engage said engaging portion of said sliding plate when said locking member is in the lock position to lock said sliding plate against said reciprocal sliding movement;

said locking member mounted to disengage said engaging portion of said sliding plate when said locking member is in the unlock position to enable said sliding plate to move in said reciprocal sliding movement;

a leaf spring for alternatively stably holding said locking member in each of said lock and unlock positions;

and a cover plate for said case body including
a connecting portion connecting said case body with the first slider,
and having a hole in said cover plate adapted to receive the projection of the second slider at a location corresponding to said tongue.

2. The lock for a slide fastener according to claim 1 wherein said tongue has a slanting surface adapted to be abutted against a top portion of the projection of the second slider.

3. The lock for a slide fastener according to claim 1 wherein said engaging portion of said sliding plate includes an engaging surface on one side of said sliding plate with said surface extending in a direction parallel to said tongue and contacting a surface of said locking member in both lock and unlock positions of said locking member, and a projecting portion on the same side of said sliding plate contacting a surface of said locking member only in the lock position of said locking member.

4. The lock for a slide fastener according to claim 1 wherein said corresponding guide member is mounted statically in said case body.

5. The lock for a slide fastener according to claim 4 wherein said guiding portion is a guide slot in said sliding plate.

6. The lock for a slide fastener according to claim 1 wherein said spring for urging said sliding plate in the direction of extension of said tongue being in uncompressed extended shape during both locked and unlocked positions of said sliding plate.

7. The lock for a slide fastener according to claim 6 wherein said spring for urging said sliding plate in the direction of extension of said tongue being in compressed shape during withdrawal of said tongue from the projection on the second slider.

8. The lock for a slide fastener according to claim 1 wherein said sliding plate having a perforation therethrough spaced from said engaging portion;

said tongue extending in the plane of said sliding plate into said perforation.

* * * * *